US008783665B2

(12) United States Patent
Kuru et al.

(10) Patent No.: US 8,783,665 B2
(45) Date of Patent: Jul. 22, 2014

(54) INTERCHANGEABLE BOTTLETOP AERATOR

(71) Applicants: Murat Kuru, Miami, FL (US); Carlos V. Freyre, Miami, FL (US)

(72) Inventors: Murat Kuru, Miami, FL (US); Carlos V. Freyre, Miami, FL (US)

( * ) Notice: Subject to any disclaimer, the term of this patent is extended or adjusted under 35 U.S.C. 154(b) by 84 days.

(21) Appl. No.: 13/660,873

(22) Filed: Oct. 25, 2012

(65) Prior Publication Data

US 2014/0120226 A1 May 1, 2014

(51) Int. Cl.
*B01F 3/04* (2006.01)

(52) U.S. Cl.
USPC ..... 261/76; 99/323.1; 426/474; 222/566

(58) Field of Classification Search
USPC ..... 261/76; 99/323.1; 426/474; 222/566
See application file for complete search history.

(56) References Cited

U.S. PATENT DOCUMENTS 8,011,540 B1 * 9/2011 Peckels ..... 222/479
2013/0319253 A1 * 12/2013 Smith ..... 99/323.1

* cited by examiner

*Primary Examiner* — Robert A Hopkins

(57) ABSTRACT

An interchangeable bottletop aerator for controllably mixing air with a liquid contained in a bottle. The apparatus includes a receptacle and an interchangeable aerator module that is inserted into the receptacle. The receptacle engages and seals the bottle through a multi lumen cylinder that extends inside the narrow neck of the bottle. It has internal structures to adjust flow characteristics of the liquid and encapsulates the module. The module has multiple channels and sections to apply predetermined aeration and flow speed to the contained liquid. The inserted module can be replaced on demand with a different module to change the aeration parameters and adapt the aeration characteristics to various liquids. The interchangeable bottletop aerator presents a solution to the changing aeration requirements of different liquids like wine in a compact, easy to use, and easy to produce package by means of simply replacing and employing different modules inside the receptacle.

20 Claims, 8 Drawing Sheets

INTERCHANGEABLE BOTTLETOP AERATOR

CROSS-REFERENCE TO RELATED APPLICATIONS

N/A

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

1. Field of the Invention

This invention relates to an interchangeable bottletop aerator that is removably engaged on top of a bottle to aerate a liquid such as different types of wine contained in the bottle while the liquid is being poured from the bottle.

2. Discussion of the Prior Art

The use of wine aerators is known in the prior art. Decanting as a means of aeration is as old as wine making. The old way of decanting wine in a vessel results in long wait periods and heterogeneous aeration of wine. Presently, more active means of decanting are performed by a plurality of aerators as well as old decanting containers. There exist several different configurations of aerators that are used external to the bottle, sit on the neck of the bottle and even inside the bottle. The self-standing aerators are the most common designs. They require using two hands or a separate stand to stabilize the aeration chamber above a wine glass like the one disclosed in U.S. Pat. No. 7,614,614 to Sabadicci et al. Further iterations of the same concept are disclosed as glass top versions in the example disclosures of U.S. Pat. No. 8,196,906 to Benton et al., U.S. Pat. App. Nos. 2011/0271846 A1 to Hynes and 2012/0201942 A1 to Kilduff et al. The wine pouring process in all these similar designs is not regulated and left to the user, frequently resulting in sub-optimal aeration and spillage. The articulated wine aerator of U.S. Pat. App. No 2012/0012718 A1 to Tiso attempts to facilitate an easier way to use aerators by means of an attachment to the containment bottle. The nonstandard outside dimensions of bottles makes this also a less than ideal solution. Example designs of bottletop aerators are disclosed in the U.S. Pat. No. 8,011,540 B1 of Peckels, and U.S. Pat. No. 8,205,541 B2 of Barberio et al. These designs consist of complicated multi piece assemblies that are difficult to clean and expensive to produce. The bottletop design that is disclosed in U.S. Pat. App. No 2012/0074092 A1 of Devoy et al. would be difficult to reuse and limited in the aeration effectiveness.

Despite the multitude of existing different designs and disclosures, there is a need in the art to improve the shortcomings of these apparatus for a bottletop aerator device to better control the aeration process of various liquids.

Notwithstanding the number of aerators and designs that have been produced, none consist of two pieces which are interchangeably engaged together to form a modular aerating mechanism that is easily altered accordingly for different wines and liquids, easy to clean, easy to produce and use on a bottletop design that is used single-handedly.

BRIEF SUMMARY OF THE INVENTION

Decanting and aeration exposes wine to air, triggering oxidation and evaporation at the same time. The job of a good aerator is helping undesirable components to evaporate faster than fruit compounds oxidize in different wine selections. As the undesirable compounds dissipate, fruit seems to intensify giving the impression of softened structure. From a chemical standpoint, wine contains hundreds of compounds. However, the fruit character and thus allure of the wine come from a small portion of them. The fruit concentration and oxidation mitigating factors such as acidity, temperature, added sulfite concentration and naturally occurring sulfides create different responses to the aeration process. This necessitates the requirement of different aeration schemes for different wines.

Most aerators work by employing the venturi principle to mix multiple liquids or gases. The fluid flowing through a channel increases speed by the decreasing channel size. This speed change creates a pressure differential if a second channel is converged at the constriction point. That fact is employed to create a vacuum effect at such narrowed channels to suction one fluid into the other thereby creating a mixing effect. These devices may have a single or plurality of sections placed alongside the flow channels sequentially.

The object of the present invention is to incorporate a solution to this requirement of controlling the aeration while solving the shortcomings of prior art. The preferred embodiment that is explained here and any other ramifications given are presented in order that the invention is better understood and as such the invention should not be considered as limited to the descriptions set forth in the text and shown in the drawings.

The present invention comprises of a housing receptacle, which is removably engaged to a bottle and an aerator module, which is interchangeably inserted into said receptacle. The receptacle contains a single cylinder section extending into the bottle to seal the inside of the bottle opening. The inside of the cylinder is bifurcated to separate the outgoing liquid flow and incoming airflow to regulate the aeration process. The liquid channel has internal structures to speed and disturb the laminar flow thereby increasing the Reynolds Number (Re) and introducing turbulence in the flow field. The turbulent flow of the liquid enables faster and more homogeneous mixing of the air and the fluid, which happens to be essentially the aeration process. Conversely in a laminar flow field, the aeration can be limited to the layers adjacent to the flow regulating container boundaries resulting in heterogeneous and sub-optimal aeration. The turbulence of the flow field is characterized by the Re which is proportional to the density of the fluid, mean velocity of the relative movement of the fluid and the container, the hydraulic diameter of the flow channel and inversely proportional to the dynamic viscosity of the fluid. The density and the viscosity of the fluid cannot be changed for a given fluid and temperature for the practical purposes of our application. The speed with which the fluid flows is the function of gravitational forces acting on the fluid during the pouring process and is inversely proportional to the orifice opening area. Thus, in theory it is possible to increase the speed of the fluid flow by constricting the orifice size of the flow from the bottle. However, surface tension effects of the boundary layers place a limit in the velocity increase for decreasing orifice openings. The optimal orifice opening in this fluid channel depends on the fluid type and the acceptable time for a certain amount of fluid to pass through it and as such cannot be manipulated beyond certain ranges. Nevertheless, the Re can be further manipulated by introducing roughness in the boundary layers and including a stifling mechanism in the flow field. The fluid channel of the receptacle of the present invention includes a stirring post and the inside walls are textured for added roughness. These, in turn, force the fluid flow to be more turbulent while passing the liquid channel of the receptacle.

Thereafter, the liquid fluidly connects to the aerator module that is slidably inserted into the receptacle. The module can be a simple design of a venturi tube. It can have multiple sequential sections like described in some of the prior art. In the preferred embodiment of the invention, the interchangeable aerator module has a plurality of parallel channels to furcate the liquid flow. Each channel has non-uniformly placed aeration holes to create different flow patterns. These holes are located in different sections that are placed consecutively in series along the individual channels. An obturator chamber follows these sections to combine and thereby further mix the flow from the plurality of incoming parallel fluid channels. The distal wall of obturator chamber creates a wave breaking and fold-back effect on the incoming multiple flow fields. The opening in the obturator wall allows the desired amount of liquid to pass while regulating the turbulent flow back to laminar flow. This orifice has a dedicated aeration hole in the preferred embodiment. The following section of the module further regulates the flow to decrease spillage and spraying.

In the distal end of the receptacle, the preferred embodiment has an undisturbed cylindrical section to engage a plug cap to seal the assembly and so the liquid inside the bottle. The same cap is designed to be employed as a base cradle when the assembly is not placed on the bottle. The opening in this distal end of the receptacle is designed in a classical pouring rim shape to eliminate dripping.

For one skilled in the art, the objects and advantages of the present invention will become apparent from a consideration of the ensuing descriptions and drawings of the preferred embodiment of the invention.

DETAILED DESCRIPTION OF THE INVENTION

Figure 1:
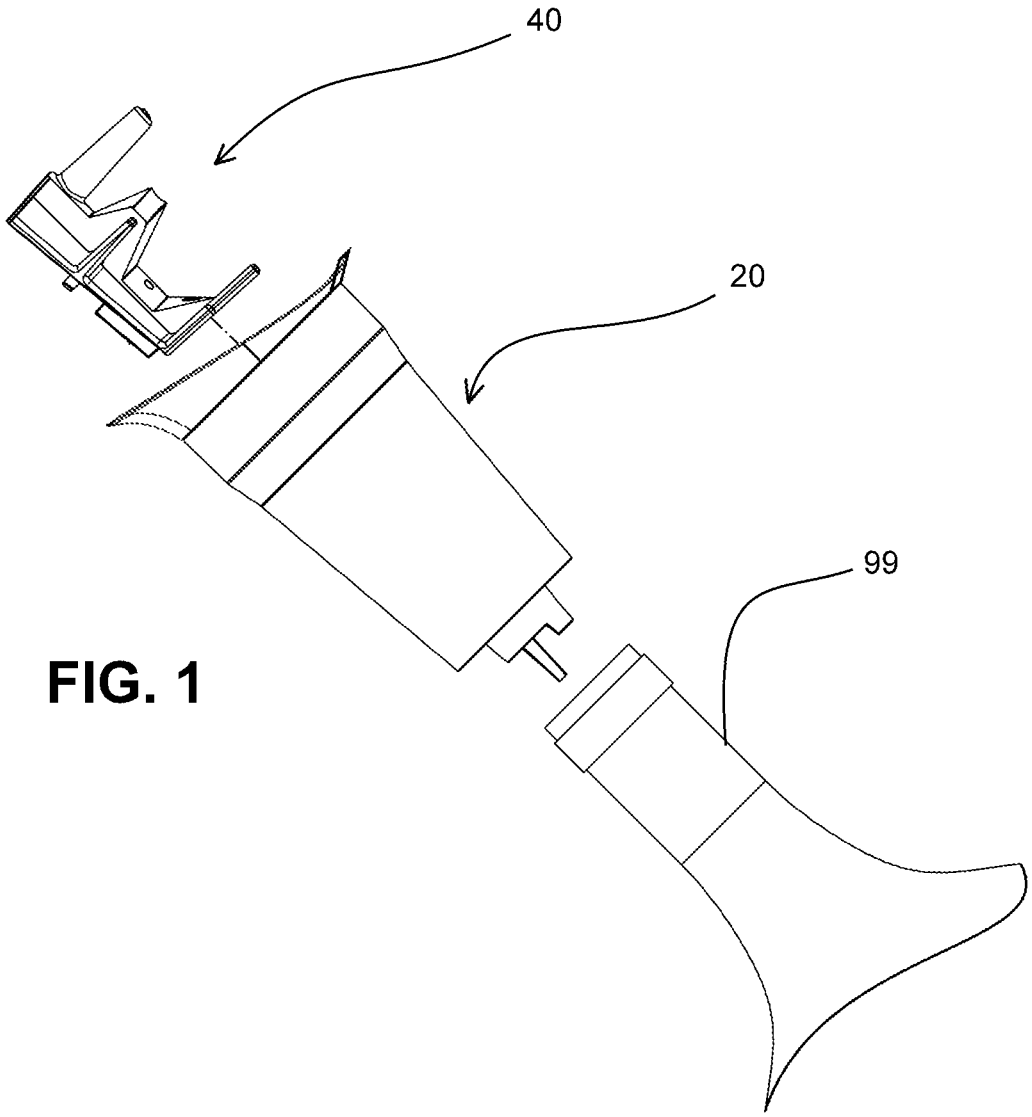
FIG. 1 is an exploded side view of present invention with a bottle

As illustrated in FIG. 1 the interchangeable bottletop aerator of the present invention consists of a receptacle, housing, carrier 20 and an interchangeable, replaceable aerator module, cartridge, insert 40 that is slidably inserted into receptacle 20, which is removably engaged to a bottle, container 99.

Figure 2A:
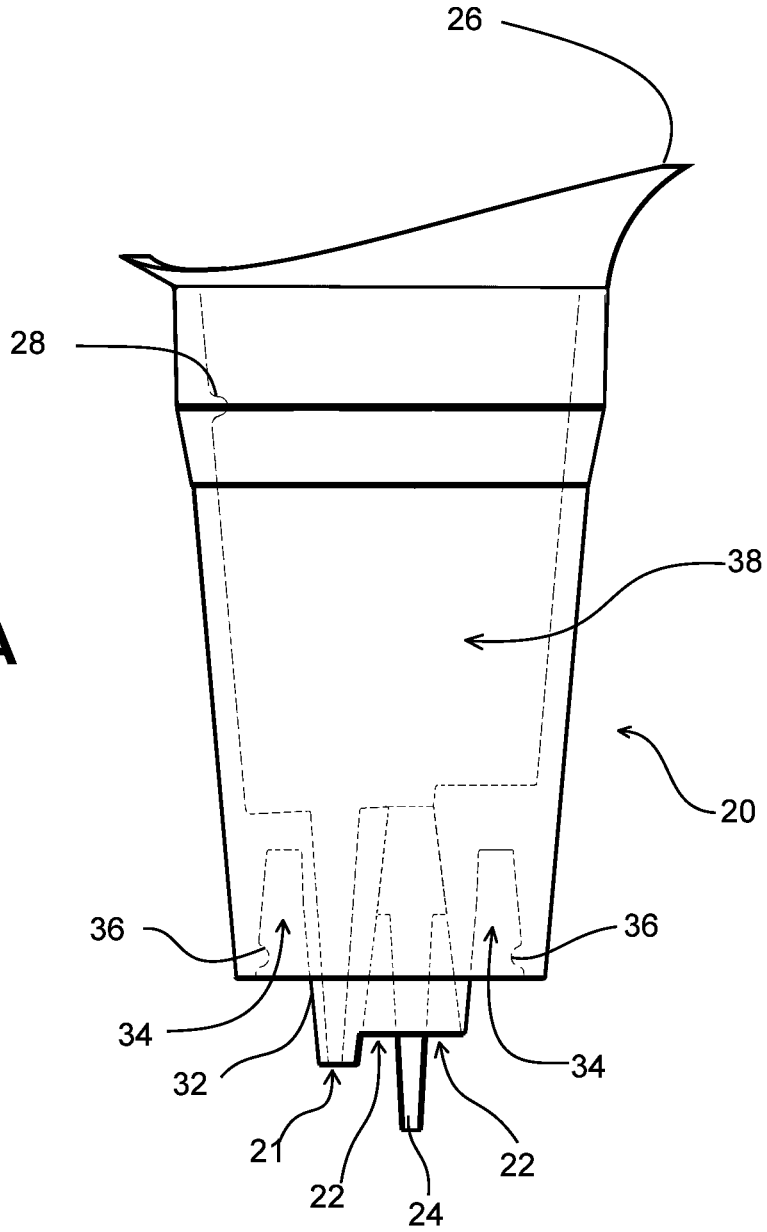
FIG. 2A is a side view of the receptacle

Receptacle 20 has a multi-lumen cylinder, cylindrical appendage member 32 at its proximal end to slidably engage into the bottle as illustrated in FIG. 2A. The cylinder is conical in nature to create the sliding into the bottle and removably seal the fluid connection between receptacle 20 and bottle 99. In the preferred embodiment of the interchangeable bottletop aerator there are two lumens inside cylinder 32. A channel, passage, duct 21 creates a passageway for the air going into the bottle to replace the emptied liquid. A second channel, passage, duct 22 is the path the emptying liquid follows. Liquid channel 22 is wider at the proximal end of receptacle 20 and narrows before fluidly connecting to a chamber 38, which houses module 40. The bottle lip sits in a slot, chamber 34 whereby cylinder 32 creates the seal between receptacle 20 and the bottle. A post, disturber, stirrer 24 is placed in the center of liquid channel 22. Post 24 is better visible in FIG. 2C along with air channel 21, fluid channel 22 and multi lumen cylinder 32. A liquid shearing no-drip lip 26 is incorporated at the distal end of receptacle 20. In order to keep aerator module 40 safely inside receptacle 20, a locking ridge, blocker 28 is placed at the distal end of chamber 38.

Figure 2B:
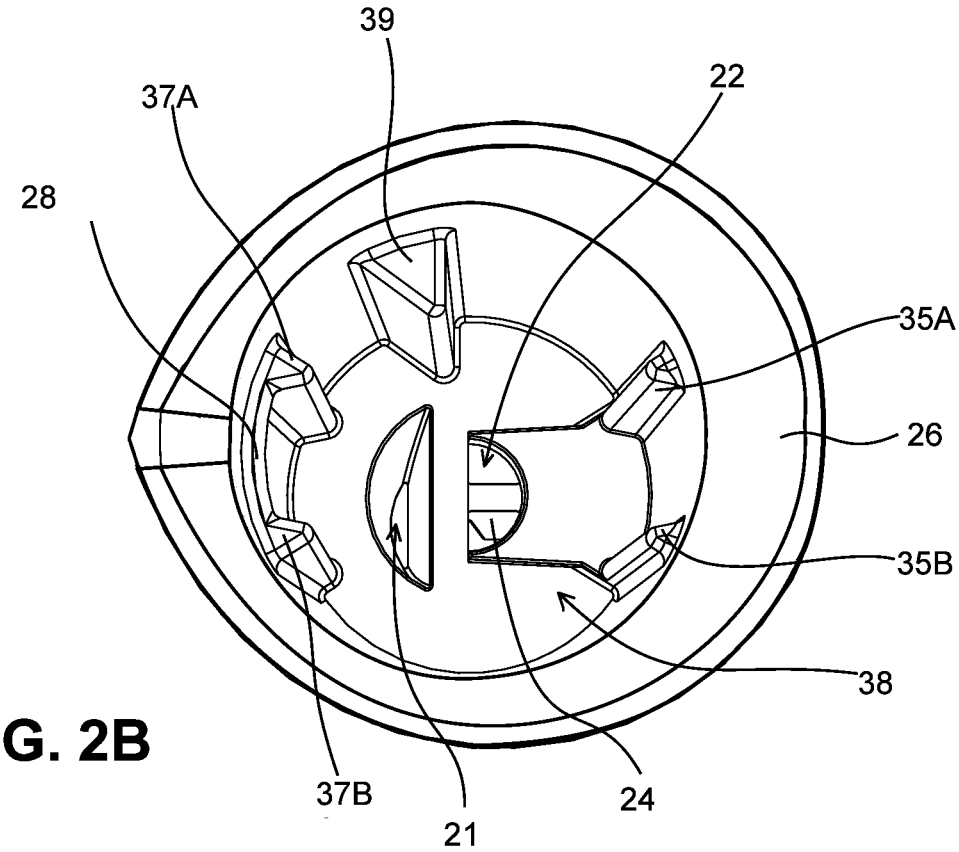
FIG. 2B is a perspective top view of the receptacle
Figure 2C:
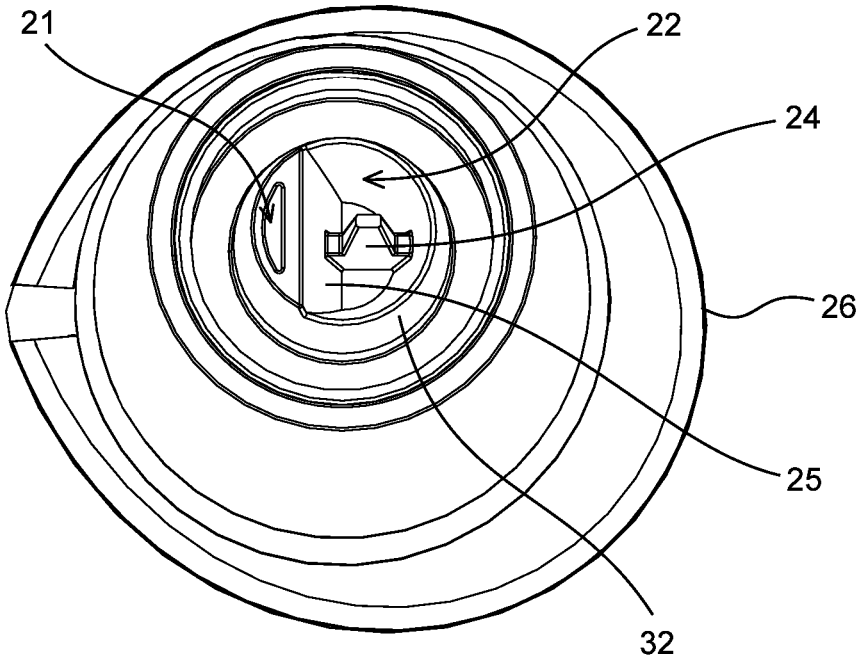
FIG. 2C is a perspective bottom view of the receptacle

FIG. 2B illustrates a top and perspective view of receptacle 20. Air channel 21, fluid channel 22 and stirrer 24 are visible at the center of the figure. Ridge 28 is supported by a right guide 37A and a left guide 37B where the guides also help keep module 40 in place. Chamber 38 also includes a placement key 39 to guide the correct insertion of module 40. A right sealing ridge 35A and a left sealing ridge 35B help placement of module 40 and further creates a seal between the module and the receptacle. FIG. 2C further illustrates a channel wall 25 that envelops liquid channel 22. Added texture and roughness on wall 25 enhance turbulence and aeration effectiveness.

Figure 3A:
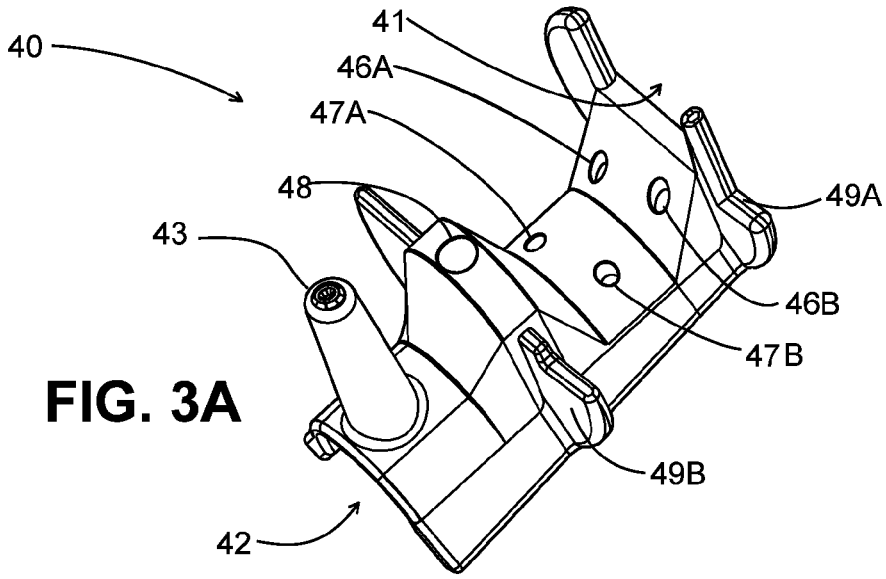
FIG. 3A is a perspective top view of the aerator module
Figure 3B:
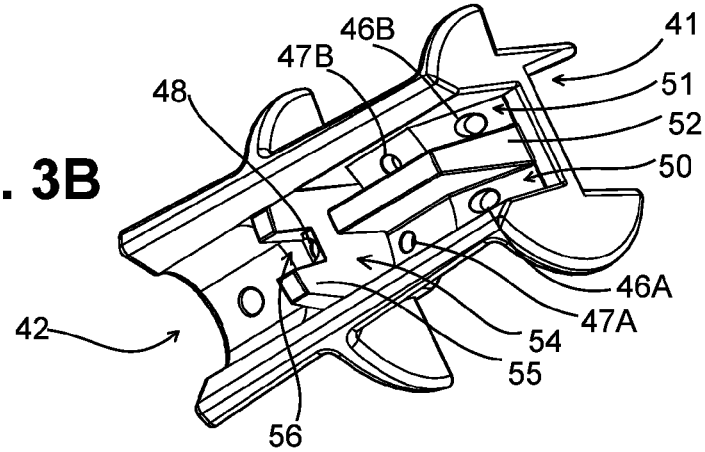
FIG. 3B is a perspective bottom view of the aerator module
Figure 3C:
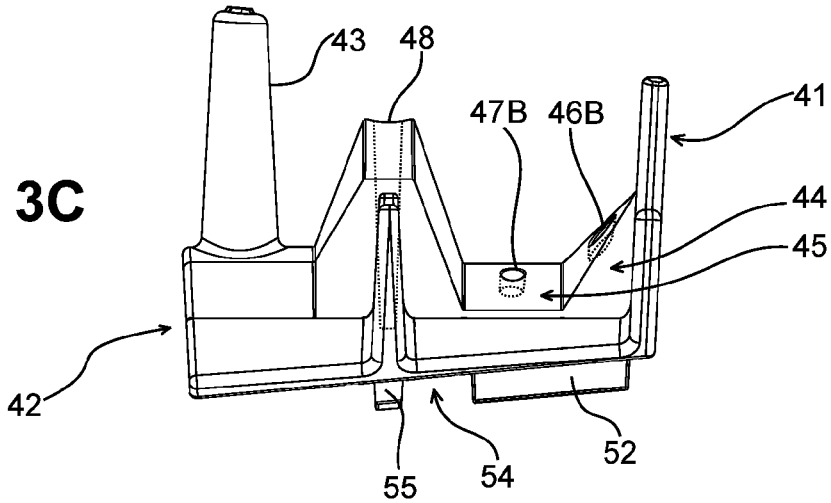
FIG. 3C is a side view of the aerator module

FIGS. 3A, 3B and 3C present a perspective top view, a perspective bottom view and side view of the preferred embodiment of interchangeable aerator module 40, respectively. An airflow channel 41 lets the passage of air into air channel 21 of the receptacle at the proximal end of the module. At the distal end of the module, a fluid channel 42 dispenses the liquid emptying from the bottle. A post, header, support 43 creates the predetermined compression to push down and seal module 40 inside chamber 38. Right and left seals 35A and 35B help this seal between module 40 and receptacle 20. Fluid channel 22 of the receptacle fluidly mates to a first fluid channel 50 and a second fluid channel 51 of the module. A divider wall, panel 52 separates channels 50 and 51. The paths of channels 50 and 51 go through an accelerator, redirection subsection 44, a linear, straight subsection 45 and a flow mixing, wave reflection, wave fold-back subsection 54. In subsection 44, channel 50 and channel 51 have aeration holes 46A and 46B, respectively. In subsection 45, channel 50 and channel 51 have aeration holes 47A and 47B, respectively. Fold-back chamber 54 is fluidly connected to a fluid regulation and control channel 56. Channel 56 has an additional aeration hole 48. A wall, separator 55 is the border between chamber 54 and channel 42. A conforming partial disc 49A is at the proximal end of the module to seat the module in chamber 38 of the receptacle. A second conforming partial guide disc 49B is placed around channel 56 to help the placement of the module around placement key 39.

Figure 4A:
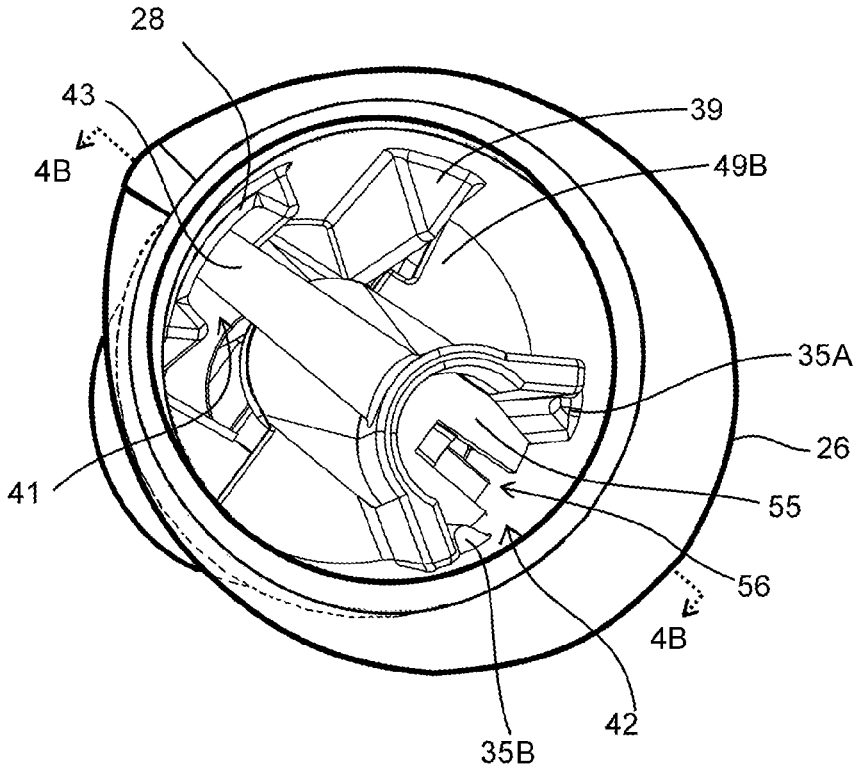
FIG. 4A is a perspective top view of the aerator module inside the receptacle

FIG. 4A illustrates module 40 inserted into receptacle 20. Right sealing ridge 35A and left sealing ridge 35B sit flush with module 40 for maintaining the tight seal between the module and the receptacle. This seal is also maintained by the static push of post 43 of module 40 in the chamber 38 of receptacle 20. Fluid regulation channel 56 and fluid flow channel 42 are visible at the distal end of the receptacle. Ridge 28 keeps the module in place by blocking post 43.

Figure 4B:
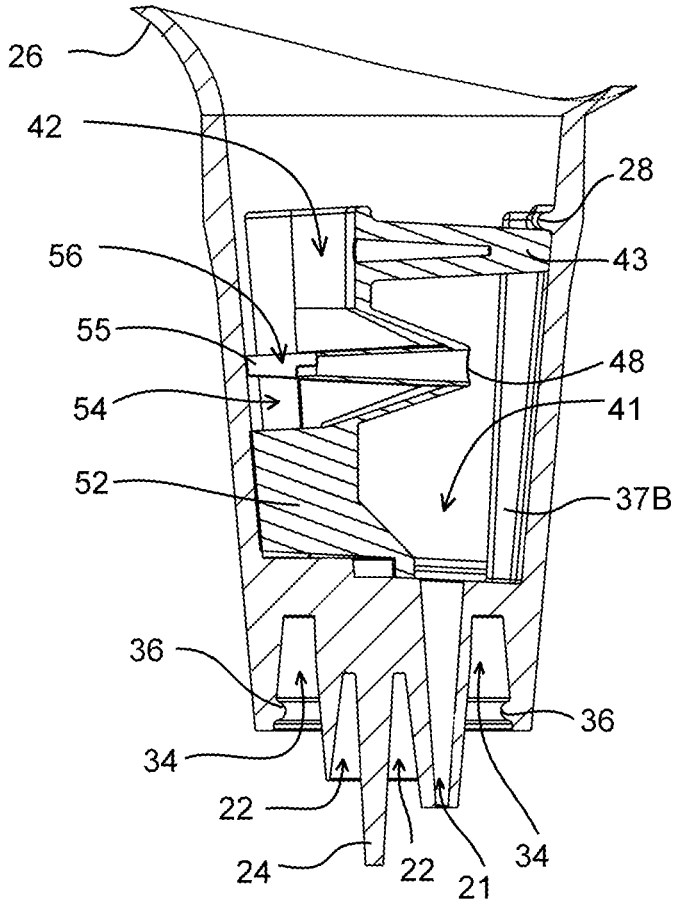
FIG. 4B is a sectional view of the aerator module inside the receptacle

The cross sectional view of module 40 inserted into receptacle 20 is shown in FIG. 4B. This view shows the abovementioned references to clarify the interactions between the module and the receptacle.

Figure 5A:
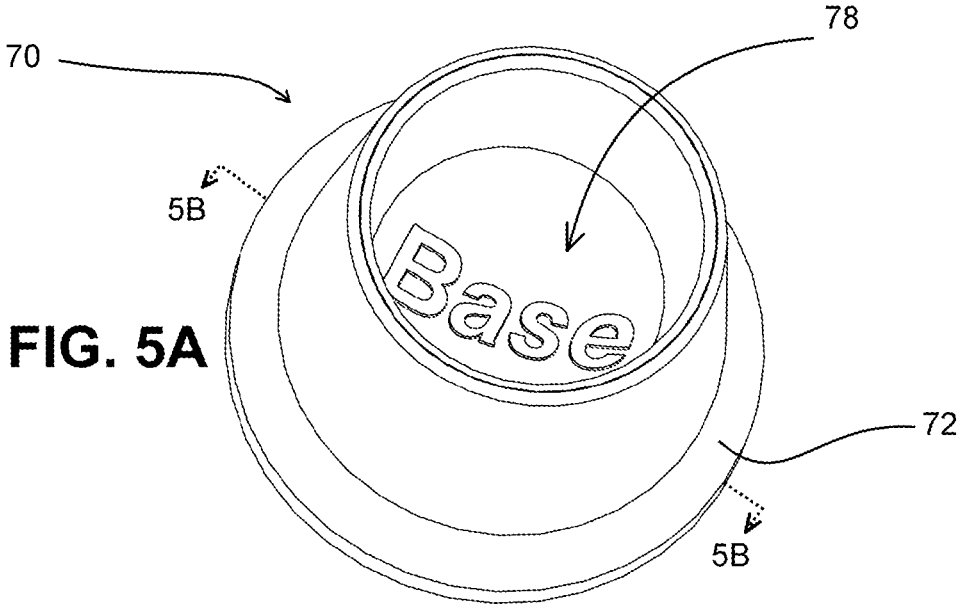
FIG. 5A is a perspective top view of the base/cap
Figure 5B:
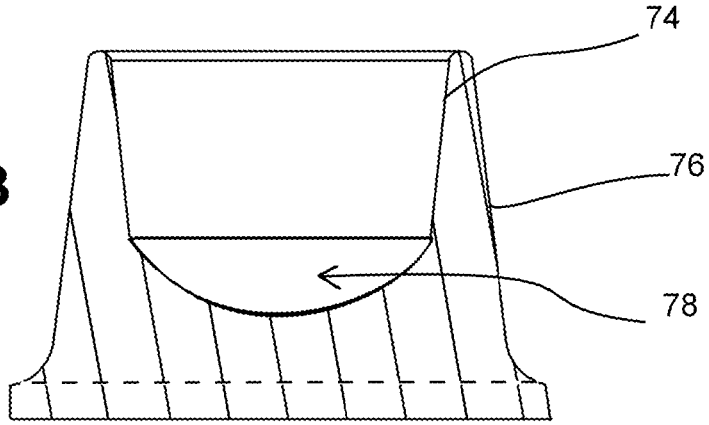
FIG. 5B is a sectional view of the base/cap
Figure 5C:
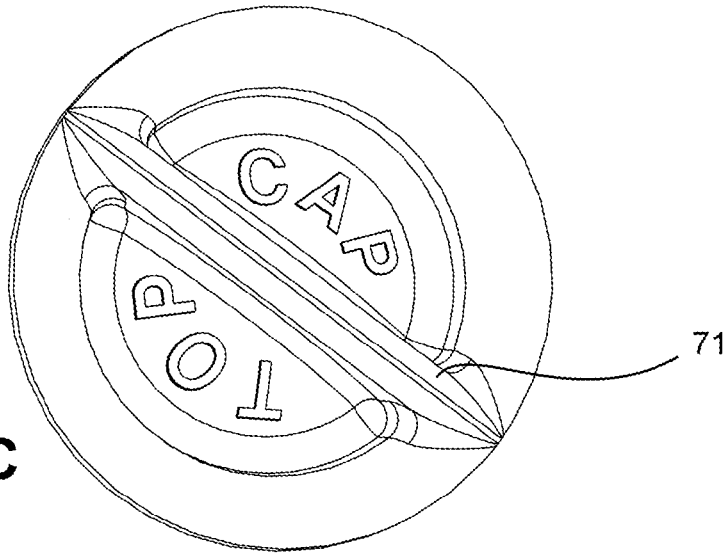
FIG. 5C is a perspective bottom view of the base/cap
Figure 6:
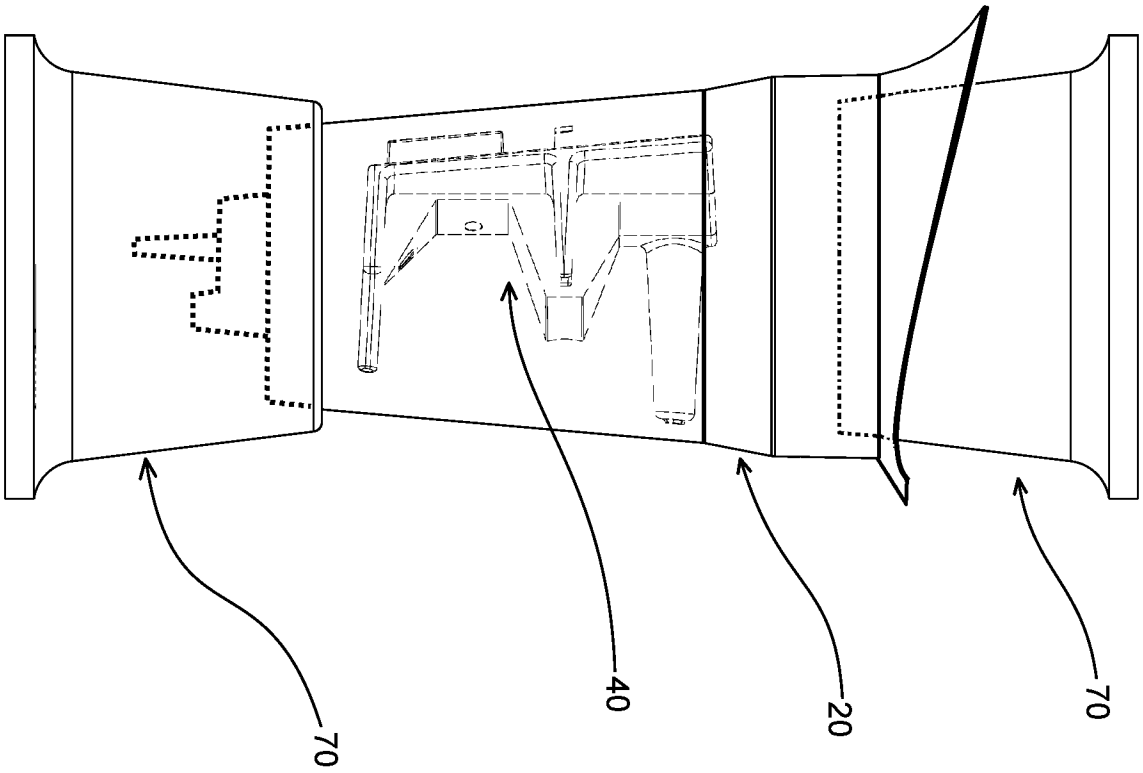
FIG. 6 is a side view of the base below and cap above the receptacle

In the preferred embodiment of the interchangeable bottletop aerator, there is a base 70 as shown in FIG. 5A. Cross sectional view of base 70 is seen in FIG. 5B. An inside wall 74 is designed to hold the proximal end of the receptacle to provide a cradle for the bottletop aerator when the aerator is not in use. Base 70 has an outside wall 76. Wall 76 has the appropriate angle to removably engage the distal end of the receptacle. This design makes the base 70 a dual use device as it can be used as a base by removably engaging the proximal end of receptacle 20 into base 70 along wall 74 and as plug 70 by removably engaging it at the distal end of receptacle 20 as illustrated in FIG. 6. A collection bowl 78 is at the bottom of base 70 to collect the left over liquid after removing the bottletop aerator from the bottle. When used as a cap, cap 70 has a ridge 71 to give the user the ability to grab and remove cap 70 from receptacle 20 as shown in FIG. 5C.

The interchangeable bottletop aerator functions by inserting aerator module 40 into receptacle 20. The receptacle is then engaged into the bottle. Cylinder 32 is designed to create a liquid tight seal between the receptacle and the bottle. The bottle is tilted to start the flow of the liquid. Lip 26 is the indicator of the discharge direction. The liquid makes contact with fluid channel 22 and speeds up as the channel narrows. The object here is creating speed and achieving turbulent flow by the increasing Re. The Re also increases by introducing stirring in the flow path. Post 24 is front facing the incoming flow and is a long weak member attached at the distal end of channel 22. The flow makes post 24 vibrate and this helps create more turbulence. Wall 25 has micro textured structure to further help to create a more turbulent fluid flow. In the other lumen of cylinder 32, airflow channel 21 lets the air flow into the bottle to replace the displaced liquid. When the liquid reaches the distal end of channel 22, it fluidly connects to subsection 44 of aerator module 40. In subsection 44, the liquid is split into multiple flow channels. In the preferred embodiment, the flow is bifurcated into fluid channel 50 and fluid channel 51. Divider wall 52 shears the flow into the fluid channels. Every obstacle in the fluid part creates roughness and increases Re that results in achieving more turbulent flow. Fluid channels 50 and 51 encounters aeration holes 46A and 46B, respectively. Holes 46A and 46B are placed with an offset to further create differences in the liquid flow patterns of their respective channels. Liquid enters the linear subsection 45 following channels 50 and 51 next. Aeration holes 47A and 47B provide more aeration. They are also placed offset to each other. The liquid flows out of channels 50 and 51 into flow mixing subsection 54. Wall 55 acts as an obturator in front of fluid channels 50 and 51. The liquid streams hit wall 55 and fold-back into each other in subsection 54 quickly filling the subsection. The individually aerated fluid streams are blended into each other in this chamber to homogenize the effect of aeration on the liquid. The blended turbulent flow of the liquid has to be brought back to laminar flow. Wall 55 has channel 56 to let the liquid out of chamber 54. The cross sectional area of channel 56 is designed to provide desired flow rate. Aerator hole 48 provides further aeration to the liquid passing through channel 56. At this point the flow is close to the distal end of the receptacle. Flow out channel 42 acts as a flow regulator to convert the flow field into a laminar flow. Consequently, the liquid flow reaches lip 26 and pours out of the bottletop aerator.

The fruit content of wine depends on multiple factors as outlined in the summary section. For different wines the aeration amount and speed make a difference in the softened structure reached at the end of aeration. The dissipation speed and amount of unwanted compounds also change the aeration requirements depending on the type of wine and winemaking techniques. Multiple parallel channels and multiple sections with dedicated aeration holes placed at different locations in the liquid flow path of aeration module 40 allows the person skilled in the art to design the appropriate aeration amount, speed and thus softened wine structure for different wines. The preferred embodiment disclosed here consist of two separate flow channels and 4 chamber subsections with 5 aeration holes. However, it should be obvious to the person skilled in the art that in a different embodiment the number of parallel channels, the number of flow path subsections, the existence, placement and size of the aeration holes can be changed to achieve the desired effect. The end user need but only interchange the aerator module inside the receptacle for different aeration schemes. In a further different embodiment, the aerator module can be designed with adjustable inner structures that the user can modify for different wines. In another embodiment, the aerator module can have helper modules that can modify the flow path structures by slidingly engaging the suitable sections of the aerator module. These helper modules can include filters for sediment catching or slowing the flow further down. Similarly, the aerator module can have removable sections to change the aeration scheme like increasing the flow speed or air flowing into the liquid.

It should be obvious to the reader that the interchangeable bottletop aerator presents a solution to the changing aeration requirements of different liquids like wine in a compact, easy to use and easy to produce package by simply replacing the interchangeable aerator module inside the receptacle.

The details of the description of the interchangeable bottletop aerator contain explanations and exemplifications of the preferred embodiment thereof. They are not limitations on the scope of the invention.

The scope of the invention is determined by the appended claims and their legal equivalents and not by the embodiments illustrated.

What is claimed is:

1. An interchangeable bottletop aerator comprising:

a. a receptacle having a hollow inside chamber to house interchangeable modules and engaging means to removably attach to a bottle holding a liquid;

b. an interchangeable aerator module slidably inserted into said receptacle; and c. locking means to hold said interchangeable aerator module in said receptacle, whereby said liquid is aerated controllably while said liquid from said bottle passes through said interchangeable aerator module housed in said receptacle by mixing with air.

2. The apparatus of claim 1 wherein said receptacle having a single cylindrical appendage member for attaching to said bottle.

3. The single cylindrical appendage member of claim 2 wherein there are multiple lumens for air and liquid flow channels.

4. The single cylindrical appendage member of claim 2 wherein said liquid flow channel has a stirrer to induce turbulence.

5. The single cylindrical appendage member of claim 2 wherein said liquid flow channel has a wall with micro textured structure to induce turbulence.

6. The apparatus of claim 1 wherein said receptacle is made from a substantially soft material to hermetically engage said bottle.

7. The apparatus of claim 1 wherein said receptacle having said hollow inside chamber has guiding means to direct said interchangeable aerator module into correct placement in said receptacle.

8. The apparatus of claim 1 wherein said interchangeable aerator module is made from rigid material from a group consisting of substantially high-durometer plastics, metals, ceramics and glass.

9. The apparatus of claim 1 wherein said interchangeable aerator module has plurality of parallel channels and serial chambers to control the means of aeration on said liquid.

10. The apparatus of claim 1 wherein said liquid is wine.

11. The apparatus of claim 1 further including an auxiliary member to be used as a base to hold said receptacle with said inserted interchangeable aerator module while not in use and as a plug to cap said receptacle with said interchangeable aerator module while in use.

12. The member of claim 11 wherein an inside wall has a predetermined angle to hold the proximal end of said receptacle.

13. The member of claim 11 wherein an outside wall has the predetermined angle to snuggly fit into the distal end of said receptacle providing plugging means to said receptacle holding said interchangeable aerator module while the assembly is engaged to said bottle.

14. A method of controllably aerating a liquid comprising:

a. engaging removably a receptacle to a bottle holding a liquid;

b. inserting an interchangeable aerator module into said receptacle;

c. locking said interchangeable aerator module in place;

d. pouring said liquid from said bottle by tilting said bottle;

e. passing said liquid through said receptacle while increasing the flow speed and turbulence;

f. passing said liquid through plurality of channels and subsections of said interchangeable aerator module to controllably mix the air with said liquid; and g. replacing said interchangeable aerator module inside said receptacle for controllably changing aeration parameters, whereby said liquid is aerated controllably by means of employing a plurality of interchangeable aerator modules to adapt the aeration to a multitude of liquids.

15. The method of claim 14 wherein locking mechanism is semi permanent.

16. The method of claim 14 wherein flow speed is controlled by inner structure of interchangeable aerator module.

17. The method of claim 14 further including plugging means to seal said liquid inside said bottle between uses.

18. The method of claim 14 wherein said interchangeable aerator module has means for replacing by hand on demand.

19. The method of claim 14 wherein said receptacle has stirring means to induce turbulence.

20. The method of claim 14 wherein said liquid is wine.

* * * * *